US006202664B1

(12) United States Patent
Shenton, Jr. et al.

(10) Patent No.: US 6,202,664 B1
(45) Date of Patent: Mar. 20, 2001

(54) TRUCK MOUNTED AWNING APPARATUS

(76) Inventors: John M. Shenton, Jr.; John M. Shenton, III, both of 910 Old North Point Rd., Baltimore, MD (US) 21224

( * ) Notice: Subject to any disclaimer, the term of this patent is extended or adjusted under 35 U.S.C. 154(b) by 0 days.

(21) Appl. No.: 09/429,457

(22) Filed: Oct. 28, 1999

Related U.S. Application Data

(60) Provisional application No. 60/188,512, filed on Nov. 16, 1998.

(51) Int. Cl.[7] ..... E04H 15/06

(52) U.S. Cl. ..... 135/88.03; 135/88.01; 135/90; 296/163

(58) Field of Search ..... 135/88.01, 88.03, 135/88.05, 88.07, 90; 296/100, 102, 104, 105, 106, 161, 163; 16/324, 326

(56) References Cited

U.S. PATENT DOCUMENTS

| | | | | |
|---|---|---|---|---|
| 558,296 | * | 4/1896 | McDonald | 135/88.03 X |
| 2,715,044 | * | 8/1955 | Neidetcher | 135/88.01 X |
| 2,821,204 | * | 1/1958 | Hartshorn, Sr. | 135/88.01 X |
| 4,263,925 | | 4/1981 | Arganbrite . | |
| 4,284,303 | | 8/1981 | Hather | 296/100 |
| 4,519,409 | | 5/1985 | Kinney et al. | 135/88.01 |
| 4,666,327 | * | 5/1987 | Su | 16/324 X |
| 5,000,210 | * | 3/1991 | Worthington, Jr. | 135/90 |
| 5,340,188 | | 8/1994 | Goble | 296/100 |
| 5,579,797 | * | 12/1996 | Rogers | 135/99 X |
| 5,660,425 | | 8/1997 | Weber | 296/163 |
| 5,921,258 | * | 7/1999 | Francois | 135/88.03 |

* cited by examiner

*Primary Examiner*—James O. Hansen

(57) ABSTRACT

An awning apparatus for mounting on a truck includes a plurality of post assemblies wherein each post assembly includes a bottom post end portion adapted to fit into a post hole in the truck and includes a riser portion connected to the post end portion. A locking hinge assembly is connected to the riser portion. An awning support member is connected to the locking hinge assembly, and a first flexible sheet member is connected to the plurality of awning support members. The awning apparatus can be used in two modes. With the first mode, for shading regions exterior to the truck, chairs can be placed under the first flexible sheet member, and persons sitting in those chairs can be shaded from sun and rain. With the second mode, for shading regions on the truck itself, persons can sit on the truck bed and be shaded from sun and rain. The locking hinge assemblies permit the first flexible sheet member to be locked into either mode. The riser portion includes a first riser member connected to the post end portion. A second riser member is telescopically connected to the first riser member, and a riser lock member is connected to the first riser member for locking the second riser member with respect to the first riser member. A second flexible sheet member is connected to a plurality of the second riser members.

3 Claims, 3 Drawing Sheets

TRUCK MOUNTED AWNING APPARATUS

CROSS-REFERENCE TO RELATED APPLICATION

This application claims priority based upon my copending Provisional Application Serial No. 60/188,512, filed Nov. 16, 1998.

BACKGROUND OF THE INVENTION

1. Field of the Invention

The present invention relates generally to awnings and, more particularly, to awnings that are supported by trucks.

2. Description of the Prior Art

Shelters carried and supported by motor vehicles are well known in the art. In this respect, throughout the years, a number of innovations have been developed relating to shelters carried by motor vehicles, and the following U.S. patents are representative of some of those innovations: U.S. Pat. Nos. 4,263,925, 4,284,303, 4,519,409, 5,340,188, and 5,660,425. More specifically, each of U.S. Pat. Nos. 4,263, 925, 4,284,303, and 5,340,188 discloses a respective cover or enclosure for a bed of a pickup truck. With each of these covers, only the respective truck bed is covered. However, in certain circumstances, such as when a person is seated adjacent to a pickup truck, it would be desirable if a truck mounted protective cover could be adjusted to protect a person seated or standing adjacent to a pickup truck.

U.S. Pat. No. 4,519,409 discloses a protective cover that is mounted on the bumper of a motor vehicle and protects an area adjacent to and behind the motor vehicle. As a result, areas adjacent to and behind the protective cover are protected from rain and sunshine. However, areas adjacent to and to the sides of the motor vehicle are not protected. In this respect, it would be desirable if a motor-vehicle-mounted protective cover were provided that protects areas adjacent to and to the sides of the motor vehicle.

U.S. Pat. No. 5,660,425 discloses a shelter that is partially supported by a pickup truck and partially supported by the ground behind the pickup truck If the ground is muddy or uneven, the shelter may not be oriented properly on muddy or uneven ground. In this respect, it would be desirable if a truck mounted awning apparatus were entirely supported by the truck without being partially supported by the ground.

Still other features would be desirable in a truck mounted awning apparatus. For example, it would be desirable if the orientation of the awning were easily changeable and selectable. More specifically, it would be desirable if a truck mounted awning apparatus were provided that can easily be reoriented from protecting areas to the sides of a truck to protecting areas on the truck bed and vice versa.

With respect to the easily changed orientation of the awning, it would be desirable if a selected orientation can easily be locked into place. Furthermore, in this respect, it would be desirable if a selected orientation locking device can easily be unlocked and relocked to accommodate a change in orientation of the awning.

Moreover, it would be desirable if a truck mounted awning apparatus were provided that permits a wide range of selectable awning orientations that can be easily locked and unlocked for changing orientations.

Thus, while the foregoing body of prior art indicates it to be well known to use protective covers supported by motor vehicles, the prior art described above does not teach or suggest a truck mounted awning apparatus which has the following combination of desirable features: (1) can be adjusted to protect a person seated or standing adjacent to a pickup truck; (2) protects areas adjacent to and to the sides of a motor vehicle; (3) is entirely supported by the truck without being partially supported by the ground; (4) can easily be reoriented from protecting areas to the sides of a truck to protecting areas on the truck bed and vice versa; (5) a selected awning orientation can easily be locked into place; (6) provides a selected orientation locking device that can easily be unlocked and relocked to accommodate a change in orientation of the awning; and (7) permits a wide range of selectable awning orientations that can be easily locked and unlocked for changing orientations.

The foregoing desired characteristics are provided by the unique truck mounted awning apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an awning apparatus for mounting on a truck which includes a plurality of post assemblies wherein each post assembly includes a bottom post end portion adapted to fit into a post hole in the truck and includes a riser portion connected to the post end portion. A locking hinge assembly is connected to the riser portion. An awning support member is connected to the locking hinge assembly, and a first flexible sheet member is connected to the plurality of awning support members. The awning apparatus can be used in two modes. With the first mode, for shading regions exterior to the truck, chairs can be placed under the first flexible sheet member, and persons sitting in those chairs can be shaded from sun and rain. With the second mode, for shading regions on the truck itself, persons can sit on the truck bed and be shaded from sun and rain.

The locking hinge assembly includes a first hinge plate member connected to the riser portion. The first hinge plate member includes a spring-biased locking pin. A second hinge plate member is connected to the awning support member. The second hinge plate member includes a plurality of locking wells. A hinge pin is connected between the first hinge plate member and the second hinge plate member.

The spring-biased locking pin includes a spring retained by the first hinge plate member and includes a lock pin member retained by the first hinge plate member. The lock pin member includes a handle portion. A pin shaft portion is connected to the handle portion. A spring compression ring supported by the pin shaft portion, and a well entry portion is connected to the pin shaft portion.

The riser portion includes a first riser member connected to the post end portion. A second riser member is telescopically connected to the first riser member, and a riser lock member is connected to the first riser member for locking the second riser member with respect to the first riser member. A second flexible sheet member is connected to a plurality of the second riser members.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved truck mounted awning apparatus which has all of the advantages of the prior art and none of the disadvantages.

It is another object of the present invention to provide a new and improved truck mounted awning apparatus which may be easily and efficiently manufactured and marketed.

It is a further object of the present invention to provide a new and improved truck mounted awning apparatus which is of durable and reliable construction.

An even further object of the present invention is to provide a new and improved truck mounted awning apparatus which is susceptible of a low cost of manufacture with regard to both materials and labor, and which accordingly is then susceptible of low prices of sale to the consuming public, thereby making such truck mounted awning apparatus available to the buying public.

Still yet a further object of the present invention is to provide a new and improved truck mounted awning apparatus which can be adjusted to protect a person seated or standing adjacent to a pickup truck.

Still another object of the present invention is to provide a new and improved truck mounted awning apparatus that protects areas adjacent to and to the sides of a motor vehicle.

Yet another object of the present invention is to provide a new and improved truck mounted awning apparatus which is entirely supported by the truck without being partially supported by the ground.

Even another object of the present invention is to provide a new and improved truck mounted awning apparatus that can easily be reoriented from protecting areas to the sides of a truck to protecting areas on the truck bed and vice versa.

Still a further object of the present invention is to provide a new and improved truck mounted awning apparatus which a selected awning orientation can easily be locked into place.

Yet another object of the present invention is to provide a new and improved truck mounted awning apparatus that provides a selected orientation locking device that can easily be unlocked and relocked to accommodate a change in orientation of the awning.

Still another object of the present invention is to provide a new and improved truck mounted awning apparatus which permits a wide range of selectable awning orientations that can be easily locked and unlocked for changing orientations.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
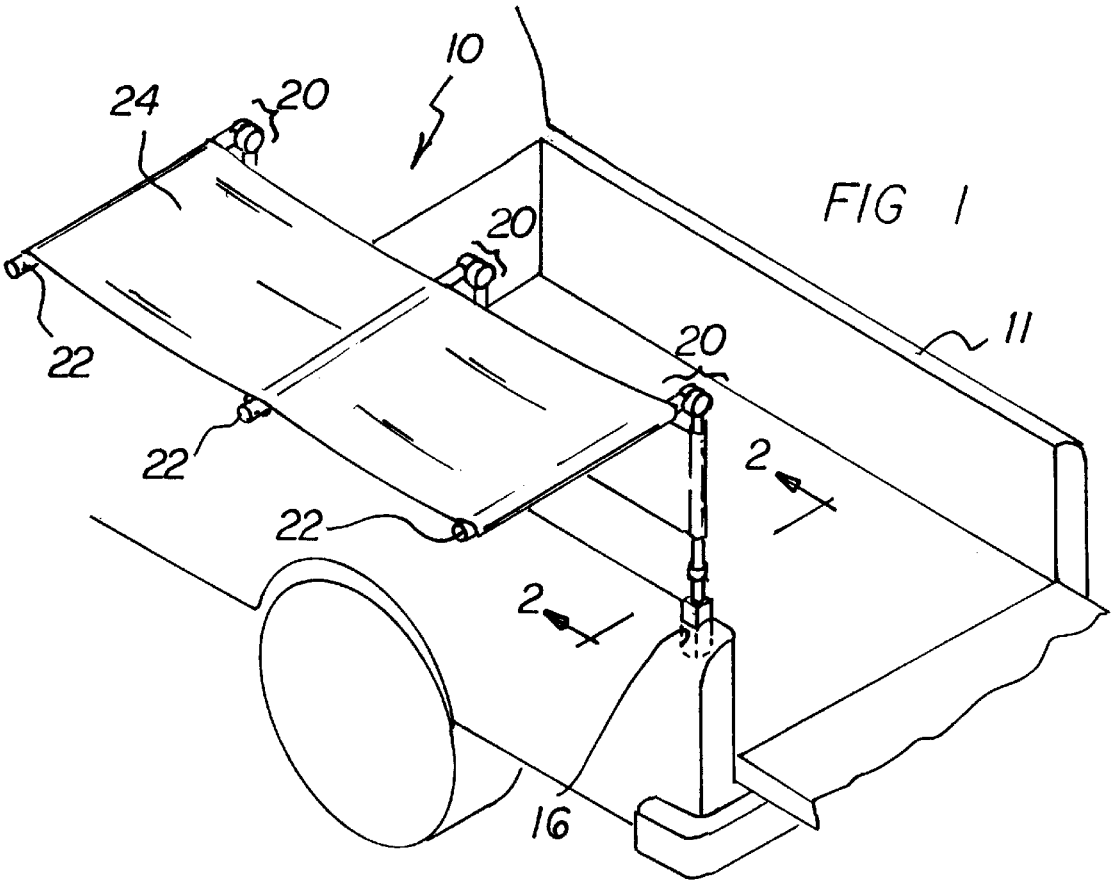
FIG. 1 is a perspective view showing a preferred embodiment of the truck mounted awning apparatus of the invention installed on a wall adjacent to a bed of a pickup truck.

With reference to the drawings, a new and improved truck mounted awning apparatus embodying the principles and concepts of the present invention will be described.

Turning to FIGS. 1–6, there is shown an exemplary embodiment of the truck mounted awning apparatus of the invention generally designated by reference numeral 10. In its preferred form, the awning apparatus 10 for mounting on a truck 11 includes a plurality of post assemblies 12 wherein each post assembly 12 includes a bottom post end portion 14 adapted to fit into a post hole 16 in the truck 11 and includes a riser portion 18 connected to the post end portion 14. A locking hinge assembly 20 is connected to the riser portion 18. An awning support member 22 is connected to the locking hinge assembly 20, and a first flexible sheet member 24 is connected to the plurality of awning support members 22.

The locking hinge assembly 20 includes a first hinge plate member 26 connected to the riser portion 18. The first hinge plate member 26 includes a spring-biased locking pin. A second hinge plate member 28 is connected to the awning support member 22. The second hinge plate member 28 includes a plurality of locking wells 32. A hinge pin 34 is connected between the first hinge plate member 26 and the second hinge plate member 28.

The spring-biased locking pin includes a spring 36 retained by the first hinge plate member 26 and includes a lock pin member retained by the first hinge plate member 26. The lock pin member includes a handle portion 40. A pin shaft portion 42 is connected to the handle portion 40. A spring compression ring 44 supported by the pin shaft portion 42, and a well entry portion 46 is connected to the pin shaft portion 42.

The riser portion 18 includes a first riser member 50 connected to the post end portion 14. A second riser member 52 is telescopically connected to the first riser member 50, and a riser lock member 54 is connected to the first riser member 50 for locking the second riser member 52 with respect to the first riser member 50. A second flexible sheet member 56 is connected to a plurality of the second riser members 52.

The awning apparatus 10 of the invention can be used in two different modes: first, shading regions exterior to the truck, and, second, shading regions on the truck itself. As shown in FIG. 1 and in the solid lines in FIG. 2, the awning apparatus 10 is used for shading regions exterior to the truck. In contrast, as shown in the broken lines 55 in FIG. 2, the awning apparatus 10 is used for shading regions on the truck itself.

Figure 4:
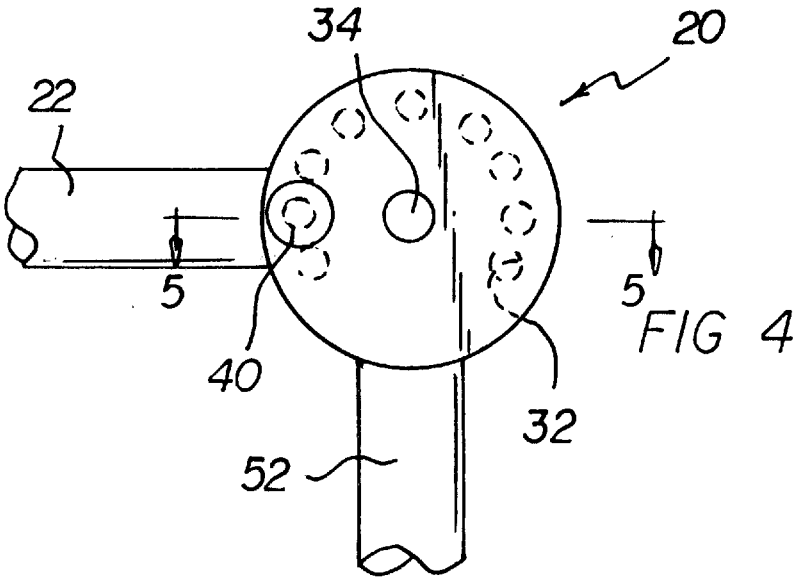
FIG. 4 is an end view of the portion of the embodiment of the invention shown in FIG. 2 contained in the circled region 4 thereof.
Figure 5:
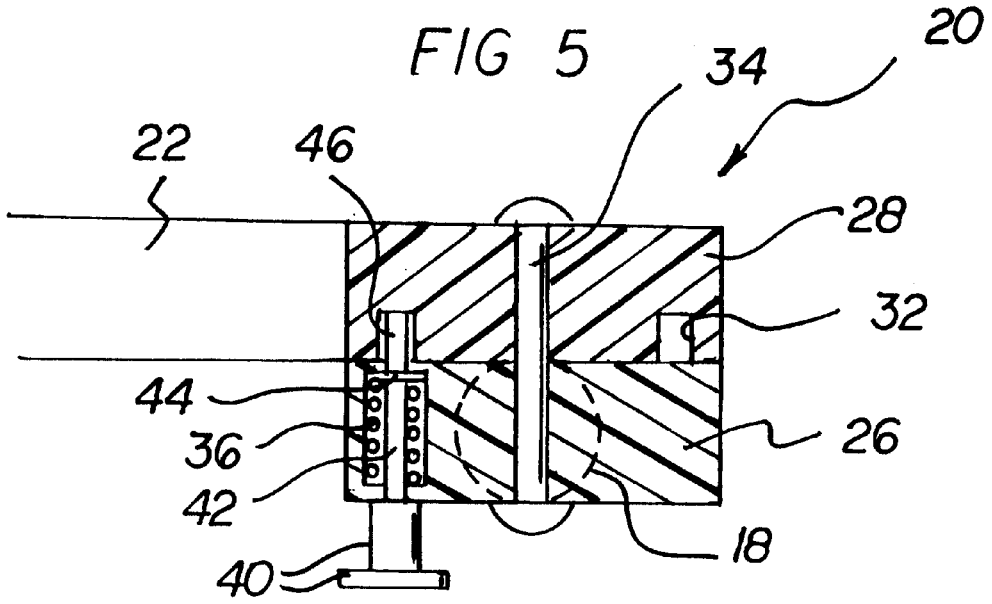
FIG. 5 is a partial cross-sectional view of the embodiment of the invention shown in FIG. 4 taken along line 5—5 thereof.
Figure 6:
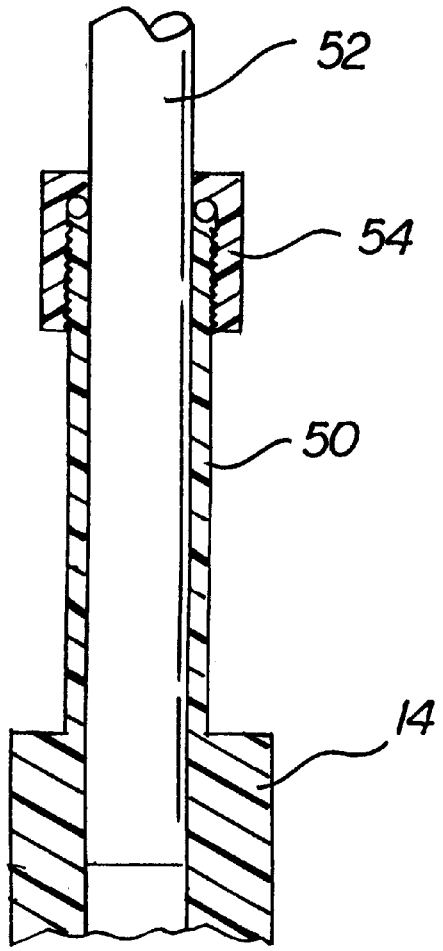
FIG. 6 is a partial cross-sectional view of the embodiment of the invention shown in FIG. 2 taken along line 6—6 thereof.

More specifically, the angle of each of the awning support members 22 with respect to the respective riser portions 18 is controlled by which locking well 32 is engaged by the well entry portion 46 of the spring-biased locking pin. The locking wells 32 are distributed around the hinge pin 34 in a circular array. As shown in FIG. 4, the locking wells 32 are distributed through an arc of approximately 270 degrees around the hinge pin 34. Therefore, the angle of the first flexible sheet member 24 with respect to the riser portions 18 can be selected in a range spanning approximately 270 degrees. As shown in FIG. 1 and in the solid lines of FIG. 2, the first flexible sheet member 24 is oriented at approximately degrees with respect to the riser portions 18 with the first flexible sheet member 24 thereby shading regions exterior to the truck.

Figure 2:
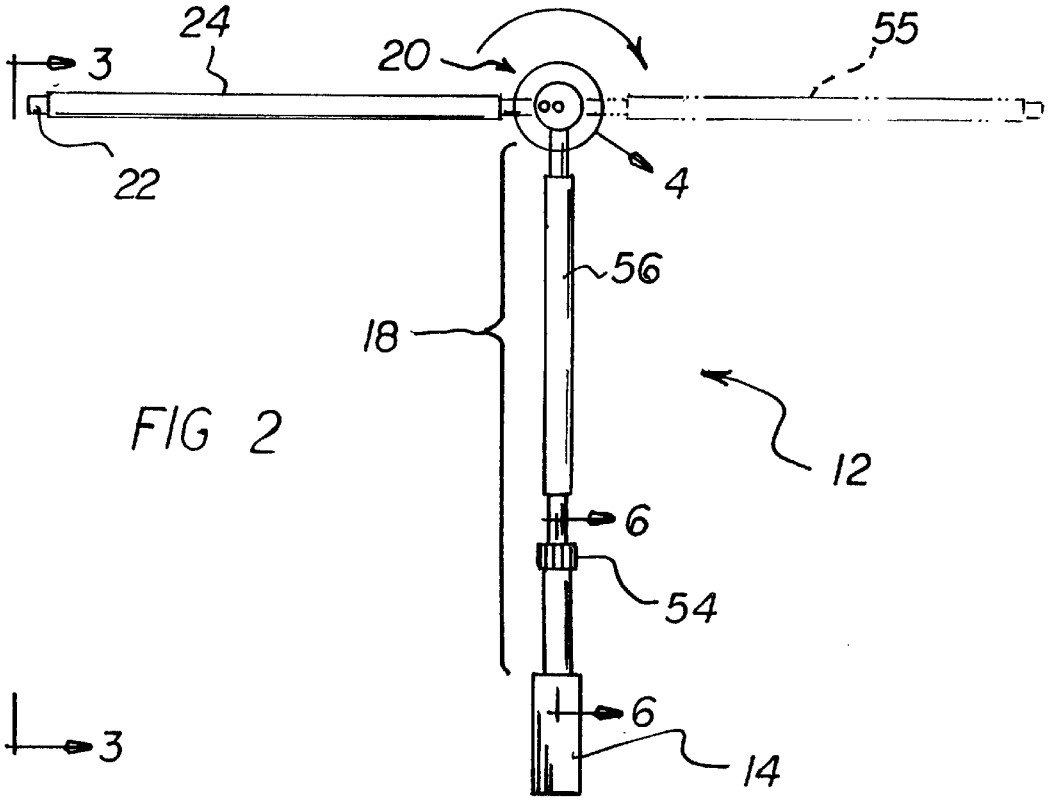
FIG. 2 is a rear view of the embodiment of the truck mounted awning apparatus shown in FIG. 1 taken along line 2—2 of FIG. 1 and removed from the pickup truck
Figure 3:
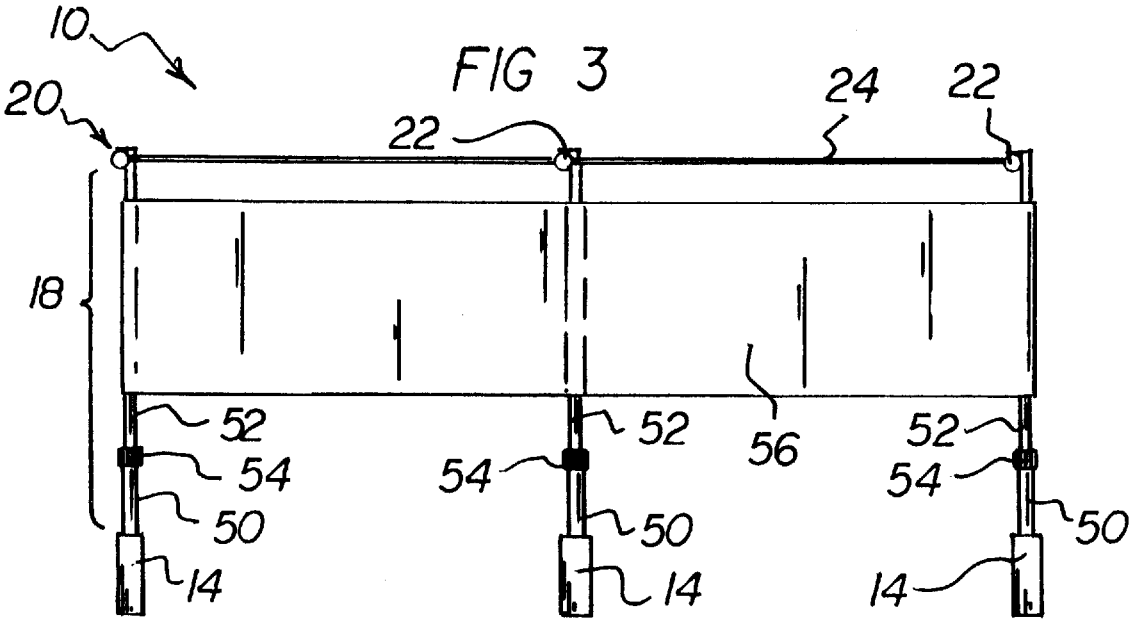
FIG. 3 is a side view of the embodiment of the truck mounted awning apparatus of FIG. 2 taken along line 3—3 thereof.

On the other hand, as shown by the broken lines 55 of FIG. 2, the awning support members 22 are rotated approximately 180 degrees clockwise around the hinge pins 34 so that the first flexible sheet member 24 shades regions on the truck itself. For whatever orientation angles of the first flexible sheet member 24 with respect to the riser portions 18 are selected, the well entry portions 46 are locked into respective locking wells 32.

To unlock a well entry portion 46 from a locking well 32, the handle portion 40 is grasped and pulled in a direction away from the respective locking well 32. In doing so, the spring 36 is compressed by the spring compression ring 44. The handle portion 40 is pulled sufficiently so that the well entry portion 46 is completely removed from a locking well 32. Then, the orientation angle of the first flexible sheet member 24 with respect to the riser portion 18 can be changed. Once a newly selected orientation angle is obtained, the handle portion 40 is released. As a result, the bias in the spring 36 causes the well entry portion 46 to enter into another locking well 32 for retaining the first flexible sheet member 24 at the newly selected orientation.

The vertical distance of the first flexible sheet member 24 from the post end portion 14 of the post assembly 12 can be adjusted by loosening the riser lock member 54, by adjusting the degree of extension of the second riser member 52 within the first riser member 50, and by retightening the riser lock member 54.

When it is desired to remove the awning apparatus 10 from the truck 11 and to place the awning apparatus 10 in storage, the post end portions 14 are removed from the post holes 16 in the wall of the truck 11, and the awning apparatus 10 can be folded while fully assembled detached from the truck 11.

With the mode for shading regions exterior to the truck, chairs can be placed under the first flexible sheet member 24, and persons sitting in those chairs can be shaded from sun and rain. With the mode for shading regions on the truck itself, persons can sit on the truck bed and be shaded from sun and rain.

The first flexible sheet member 24 and the second flexible sheet member 56 can be made from a variety of materials, including tarpaulin material.

The components of the truck mounted awning apparatus of the invention can be made from inexpensive and durable metal, plastic, and cloth materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved truck mounted awning apparatus that is low in cost, relatively simple in design and operation, and which may advantageously can be adjusted to protect a person seated or standing adjacent to a pickup truck With the invention, a truck mounted awning apparatus is provided which protects areas adjacent to and to the sides of a motor vehicle. With the invention, a truck mounted awning apparatus is provided which is entirely supported by the truck without being partially supported by the ground. With the invention, a truck mounted awning apparatus is provided which can easily be reoriented from protecting areas to the sides of a truck to protecting areas on the truck bed and vice versa With the invention, a truck mounted awning apparatus is provided which a selected awning orientation can easily be locked into place. With the invention, a truck mounted awning apparatus provides a selected orientation locking device that can easily be unlocked and relocked to accommodate a change in orientation of the awning. With the invention, a truck mounted awning apparatus is provided which permits a wide range of selectable awning orientations that can be easily locked and unlocked for changing orientations.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An awning apparatus for mounting on a truck, comprising:

a plurality of post assemblies wherein each post assembly includes a bottom post end portion adapted to fit into a post hole in the truck and includes a riser portion connected to said post end portion, a locking hinge assembly connected to said riser portion, an awning support member connected to said locking hinge assembly, and a first flexible sheet member connected to said plurality of awning support members, wherein said locking hinge assembly includes:

a first hinge plate member connected to said riser portion, wherein said first hinge plate member includes a spring-biased locking pin, a second hinge plate member connected to said awning support member, wherein said second hinge plate member includes a plurality of locking wells, and a hinge pin connected between said first hinge plate member and said second hinge plate member, wherein said spring-biased locking pin includes:

a spring retained by said first hinge plate member, and a lock pin member retained by said first hinge plate member, wherein said lock pin member includes a handle portion, a pin shaft portion connected to said handle portion, a spring compression ring supported by said pin shaft portion, and a well entry portion connected to said pin shaft portion.

2. The apparatus of claim 1 wherein said riser portion includes:

a first riser member connected to said post end portion, a second riser member telescopically connected to said first riser member, and a riser lock member connected to said first riser member for locking said second riser member with respect to said first riser member.

3. The apparatus of claim 2, further including:

a second flexible sheet member connected to a plurality of said second riser members.

* * * * *